US005421425A

United States Patent [19]

Griffin

[11] Patent Number: 5,421,425

[45] Date of Patent: Jun. 6, 1995

[54] CUTTING ELEMENTS FOR ROTARY DRILL BITS

[75] Inventor: Nigel D. Griffin, Whitminster, England

[73] Assignee: Camco Drilling Group Limited

[21] Appl. No.: 270,031

[22] Filed: Jul. 1, 1994

[30] Foreign Application Priority Data

Jul. 7, 1993 [GB] United Kingdom ..... 9314031

[51] Int. Cl.[6] ..... E21B 10/46

[52] U.S. Cl. ..... 175/432

[58] Field of Search ..... 175/420.1, 420.2, 426, 175/428, 432, 434, 435, 329

[56] References Cited

U.S. PATENT DOCUMENTS 4,877,096 10/1989 Tibbitts ..... 175/432
5,060,739 10/1991 Griffin ..... 175/432
5,355,969 10/1994 Hardy et al. ..... 175/432

FOREIGN PATENT DOCUMENTS 0032428 7/1981 European Pat. Off. .
0358526 3/1990 European Pat. Off. .
2212190 7/1989 United Kingdom .

*Primary Examiner*—Michael Powell Buiz

[57] ABSTRACT

A cutting element for a rotary drill bit comprises a thin cutting table of polycrystalline diamond having a front cutting face and a rear surface bonded to a tungsten carbide substrate. The substrate incorporates one or more thin barrier layers which extend at least partly through the thickness of the substrate in a direction transverse to its front surface. Each barrier layer is formed of a material, such as nickel, which is more ductile than the material of the substrate, but is metallurgically compatible with it.

16 Claims, 2 Drawing Sheets

FIG 5
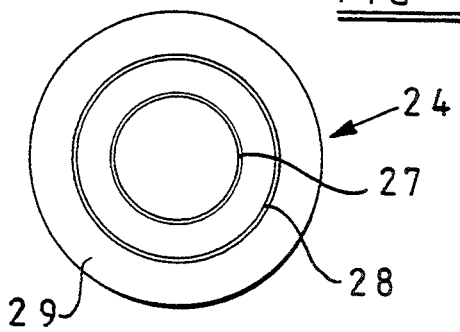
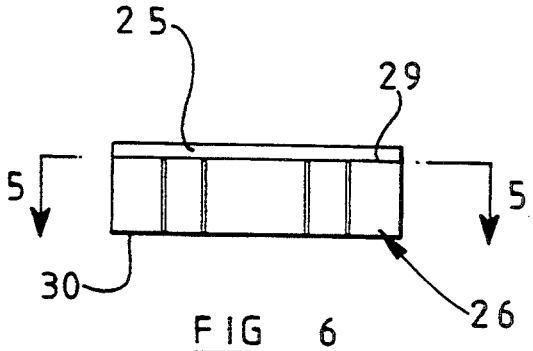
FIG 6
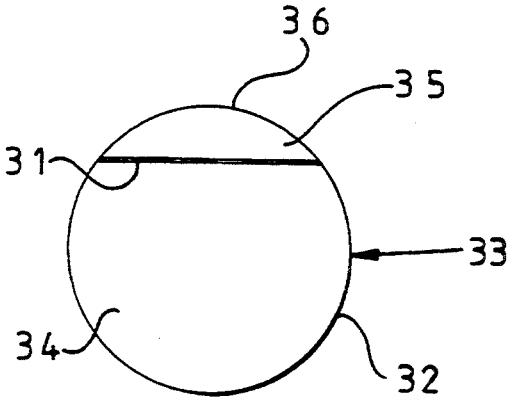
FIG 7
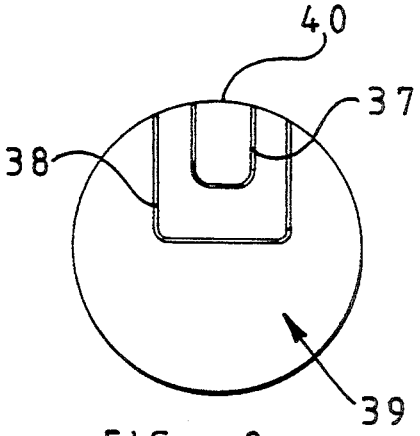
FIG 8

CUTTING ELEMENTS FOR ROTARY DRILL BITS

BACKGROUND OF THE INVENTION

The invention relates to cutting elements for rotary drill bits for use in drilling or coring holes in subsurface formations.

In particular, the invention is applicable to cutting structures for rotary drill bits of the kind comprising a bit body having a shank for connection to the drill string and an inner passage for supplying drilling fluid to the face of the bit, the bit body carrying a plurality of cutting elements. Each cutting element, often in the form of a circular disc, is a two-layer or multi-layer element including a thin front cutting table formed of superhard material, usually polycrystalline diamond, having a front cutting face and a rear face bonded to the front surface of a substrate of less hard material, such as cemented tungsten carbide. The rear face of the substrate may be bonded to a carrier, which may also comprise cemented tungsten carbide, mounted on the bit body. In one common form of drill bit of this type, the carrier comprises a stud or post to which the cutting element is brazed, the stud or post being received and secured within a socket in the bit body.

It has been found that cutting elements of the above kind may sometimes be subject to failure by a phenomenon which may be referred to as "diametral splitting". That is to say, after the drill bit has been in use, perhaps for only a limited period, some circular cutting elements become cracked or split along a diameter extending away from the cutting edge of the element and in a plane which is generally perpendicular to the surface of the formation being cut. Such splitting may be accompanied by breakdown of the bond between the rear surface of the substrate of the cutting element and the surface of the carrier to one side of the split, with the result that one half of the cutting element breaks away from the carrier thus rendering the cutting element substantially ineffective. In another mode of failure the split has been found to extend through into the main body of the carrier itself so that a portion of the carrier becomes detached, taking with it one half of the cutting element.

The present invention sets out to provide a novel form of cutting element which is designed to limit the propagation of cracks in the substrate which originate at or in the vicinity of the cutting edge, and thus reduce the incidence of diametral splitting.

SUMMARY OF THE INVENTION

According to the invention there is provided a cutting element for a rotary drill bit comprising a thin cutting table of superhard material having a front cutting face and a rear surface bonded to the front surface of a substrate of less hard material, the substrate incorporating at least one thin barrier layer of a material which is more ductile that the material of the substrate, but is metallurgically compatible therewith, the barrier layer extending at least partly through the thickness of the substrate in a direction transverse to the front surface of the substrate.

In use, the barrier layer of more ductile material serves to intercept any crack which is beginning to propagate through the substrate so that it cannot propagate entirely across the substrate and effect the diametral splitting or other catastrophic failure of the kind referred to above.

As previously mentioned the thin cutting table may be formed from polycrystalline diamond, and the substrate may be formed from tungsten carbide, or a composite including tungsten carbide and tungsten metal, with or without other materials. The material of the barrier layer may be nickel, but any other material may be employed provided that it is more ductile than the material of the substrate and is metallurgically compatible therewith.

The barrier layer preferably extends at right angles to the front surface of the substrate, and also preferably has an edge which lies at or adjacent said front surface. The barrier layer preferably extends completely through the thickness of the substrate, although arrangements are possible where it extends only part way through the thickness of the substrate.

The barrier layer may have opposite ends which are located at or near the peripheral surface of the substrate so that the barrier layer substantially divides the substrate into two portions as viewed at right angles to the front surface thereof.

Preferably the cutting element has a cutting edge which is located substantially wholly on one of said two portions of the substrate and the associated cutting table, so that a crack initiated on the cutting edge will be intercepted by the barrier layer, and halted, as it propagates towards the other portion of the substrate.

Preferably the portion of the substrate containing the cutting edge is a minor portion of the substrate, so that the barrier layer is spaced only a short distance from the cutting edge, compared to the width of the cutting element.

The barrier layer may comprise a substantially straight stretch of said more ductile material. Alternatively the barrier layer may be substantially U-shaped as viewed at right angles to the front surface of the substrate.

In a further embodiment the barrier layer forms an enclosed area within the substrate as viewed at right angles to the front surface thereof. For example, where the cutting element is in the form of a circular tablet the barrier layer may be in the form of a ring of said more ductile material, which may be concentric with the cutting element.

In any of the above arrangements there may be provided two or more barrier layers which are spaced apart as viewed at right angles to the front surface of the substrate. The substrate may comprise different materials, or materials of different compositions, on opposite sides of one or more of the barrier layers.

BRIEF DESCRIPTION OF THE DRAWINGS

FIG. 5 is a horizontal section through a cutting element in accordance with the invention, and taken along line 5—5 of FIG. 6 so as to show the front surface of the substrate, FIG. 6 is a section through the cutting element of FIG. 5, and FIGS. 7 and 8 are further sections, similar to FIG. 5, through alternative forms of cutting element according to the invention.

DETAILED DESCRIPTION OF THE PREFERRED EMBODIMENTS

Figure 1:
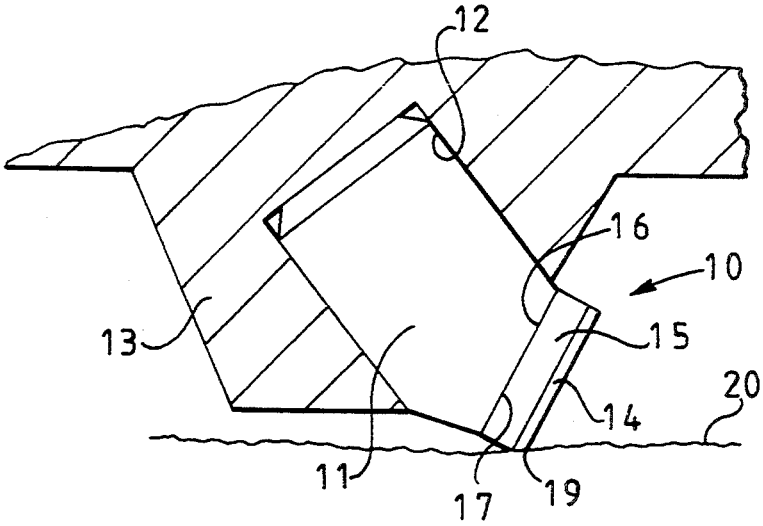
FIG 1 (PRIOR ART)
FIG. 1 is a diagrammatic side elevation of a typical cutting structure, for a rotary drill bit, incorporating a cutting element of a kind to which the present invention relates.

FIG. 1 is a diagrammatic side elevation of a typical prior art cutting structure mounted on a drag-type drill bit for use in drilling or coring holes in subsurface formations.

The cutting structure comprises a two-layer preform cutting element 10 mounted on a carrier 11 in the form of a stud which is located in a socket 12 in an upstanding blade 13 on the bit body. The preform cutting element is in the form of a circular tablet comprising a thin facing table 14 of polycrystalline diamond the rear surface of which is bonded to the front surface of a substrate 15 of less hard material such as cemented tungsten carbide or tungsten carbide/tungsten metal composite. The rear face 16 of the substrate 15 is brazed to a suitably orientated surface 17 on the stud 11, which may also be formed from tungsten carbide or tungsten carbide/tungsten composite.

It will be appreciated that FIG. 1 illustrates only one example of many possible variations of the type of cutting structure to which the invention is applicable and many other arrangements will be known to those skilled in the art.

Figure 2:
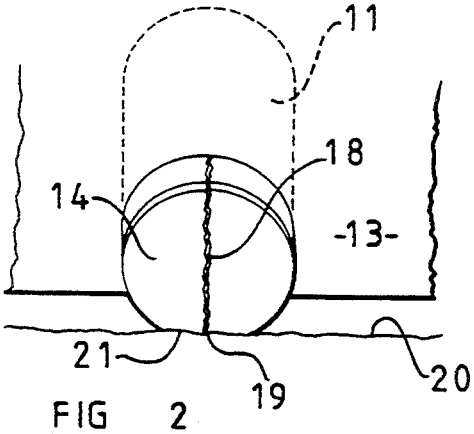
FIG 2 (PRIOR ART)
FIG. 2 is a front view of the cutting structure of FIG. 1 showing diametral splitting.

FIG. 2 is a diagrammatic front elevation of the cutting structure of FIG. 1 and illustrates one kind of failure modes, herein referred to as "diametral splitting", to which such cutting structures may be subject. As will be seen from FIG. 2, a crack or split 18 appears in the cutting element 14 and extends generally along a diameter of the circular cutting element from a point on the cutting edge 19 where the cutting element engages the formation 20. FIG. 2 illustrates the situation after the bit has been in use and a wear flat 21 has developed.

Figure 3:
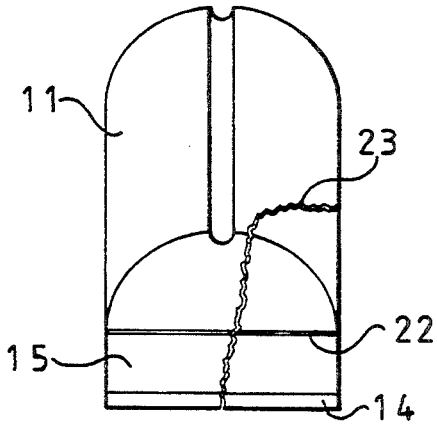
FIG 3 (PRIOR ART)
FIGS. 3 and 4 show diagrammatically two alternative forms which diametral splitting may take.
Figure 4:
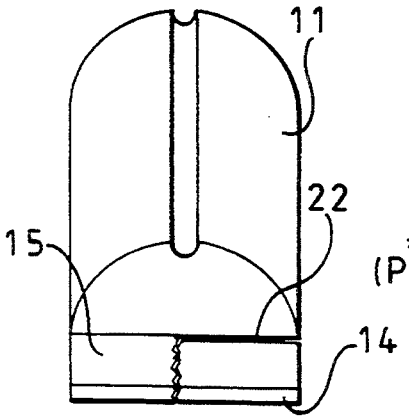
FIG 4 (PRIOR ART)

FIGS. 3 and 4 illustrate diagrammatically two alternative failure modes which can occur as a result of diametral splitting. It is believed that the crack 18 originates in the substrate 15 and it may not always extend into the diamond table 14. However the crack does not remain in the substrate and two primary forms of crack propagation are seen to occur. These are shown in FIGS. 3 and 4 respectively. FIG. 3 shows one type in which the crack traverses the brazed joint 22 between the substrate and carrier 11 and continues through the carrier 11, as indicated at 23, resulting in the loss of half of the cutting element and of a portion of the carrier.

FIG. 4 shows a second type in which the crack 18 turns through 90° and propagates along the brazed joint 22, again resulting in the loss of half the cutting element. Other secondary failure modes are also observed which lead to total bond failure and post fracture.

FIGS. 5–8 show cutting elements according to the invention where the substrate incorporates one or more barrier layers of more ductile material located so as to intercept any crack which begins to propagate from the cutting edge of the cutting element and prevent it propagating right across the cutting element to an extent where catastrophic failure can occur as described with reference to FIGS. 1–4.

FIGS. 5 and 6 are sections through a circular cutting element 24 comprising a thin front cutting table 25 of polycrystalline diamond which is bonded, in a high pressure, high temperature press, to a substrate 26 which may be formed from tungsten carbide, tungsten carbide/tungsten metal composite or any other suitable hard material which is less hard than the polycrystalline diamond.

Incorporated in the substrate 26 during manufacture are concentric circular barrier layers 27, 28 each comprising a thin layer of nickel or other material which is more ductile than the material of the substrate, but is metallurgically compatible therewith so as to be bonded to the material of the substrate during the manufacturing process.

Each barrier layer 27, 28 extends at right angles to the front surface 29 of the substrate 26 and extends through the full thickness or depth of the substrate to the rear face 30 thereof.

In this arrangement, where the cutting element is symmetrical, any part of the peripheral surface of the cutting element may be used as the cutting edge and any crack which is initiated at the cutting edge, and tends to propagate across the cutting element, for example in a diametral direction, will be intercepted by the barrier layers 27, 28 which will dissipate the local stresses at the end of the crack and prevent its further propagation across the substrate.

Instead of the two concentric barrier layers shows in FIGS. 5 and 6, only a single barrier layer, or a greater number of barrier layers, may be employed. Although the barrier layers are shown as extending through the full thickness of the substrate 26, one or more of the barrier layers may extend only part way through the substrate.

All the three concentric portions of the substrates defined by the barrier layers may be of the same composition, but the invention includes within its scope arrangements where the different portions are of different composition. For example there may be advantage in the outer annular layer of the substrate being of such composition as to be of greater impact resistance, or greater erosion resistance, than the layers inwardly thereof.

FIG. 7 shows an alternative embodiment wherein the barrier layer 31 of more ductile material comprises a straight stretch of such material the opposite ends of which lie in the peripheral surface 32 of the substrate 33. The barrier layer 31 is so positioned as to divide the substrate into a major segment 34 and a minor segment 35. Again, the barrier layer 31 may extend through the whole thickness of the substrate or only partly through its thickness.

In this arrangement the cutting element is so orientated, in use, that the cutting edge of the cutting element, as indicated as 36, is located close to the barrier layer 31 so as to minimise the extent to which a crack may be propagated from the cutting edge 36 before it reaches the barrier layer 31.

FIG. 8 shows a further alternative arrangement in which there are provided two spaced generally U-shaped barrier layers 37 and 38 formed in the substrate 39. In this case the cutting element is so orientated in use that the cutting edge 40 is disposed between the end extremities of the inner barrier layer 37.

In the examples shown the cutting elements are of a kind which are normally intended to be mounted on a stud or post which is received in a socket in the bit body. However, in another well known form of cutting element the substrate is of substantially greater axial extent than is the case with those illustrated so that the substrate itself can be directly mounted in a socket in the bit body without first having to be mounted on a carrier. In this case also, the barrier layer or layers in accordance with the present invention may extend wholly or partly through the axial length of the elongate substrate.

I claim:

1. A cutting element for a rotary drill bit comprising a thin cutting table of superhard material having a front cutting face and a rear surface bonded to the front surface of a substrate of less hard material, the substrate incorporating at least one thin barrier layer of a material which is more ductile than the material of the substrate, but is metallurgically compatible therewith, the barrier layer extending at least partly through the thickness of the substrate in a direction transverse to the front surface of the substrate.

2. A cutting element according to claim 1, wherein the cutting table is formed from polycrystalline diamond, and the material of the substrate is selected from tungsten carbide and a composite including tungsten carbide and tungsten metal.

3. A cutting element according to claim 1, wherein the material of the barrier layer is nickel.

4. A cutting element according to claim 1, wherein the barrier layer extends at right angles to the front surface of the substrate.

5. A cutting element according to claim 1, wherein the barrier layer has an edge which lies adjacent the front surface of the substrate.

6. A cutting element according to claim 1, wherein the barrier layer extends completely through the thickness of the substrate.

7. A cutting element according to claim 1, wherein the barrier layer has opposite ends which are located adjacent the peripheral surface of the substrate so that the barrier layer substantially divides the substrate into two portions as viewed at right angles to the front surface thereof.

8. A cutting element according to claim 7, having a cutting edge which is located substantially wholly on one of said two portions of the substrate and the associated cutting table.

9. A cutting element according to claim 8, wherein the portion of the substrate containing the cutting edge is a minor portion of the substrate, so that the barrier layer is spaced only a short distance from the cutting edge, compared to the width of the cutting element.

10. A cutting element according to claim 1, wherein the barrier layer comprises a substantially straight stretch of said more ductile material.

11. A cutting element according to claim 1, wherein the barrier layer is substantially U-shaped as viewed at right angles to the front surface of the substrate.

12. A cutting element according to claim 1, wherein the barrier layer forms an enclosed area within the substrate as viewed at right angles to the front surface thereof.

13. A cutting element according to claim 12, wherein the cutting element is in the form of a circular tablet and the barrier layer is in the form of a ring of said more ductile material.

14. A cutting element according to claim 13, wherein the barrier layer is substantially concentric with the cutting element.

15. A cutting element according to claim 1, wherein there are provided at least two barrier layers which are spaced apart as viewed at right angles to the front surface of the substrate.

16. A cutting element according to claim 15, wherein the substrate comprises different materials, on opposite sides of at least one of the barrier layers.

* * * * *